US005238162A

United States Patent [19]

LaCivita

[11] Patent Number: 5,238,162

[45] Date of Patent: Aug. 24, 1993

[54] DEVICE FOR CARRYING BALLS

[75] Inventor: Robert A. LaCivita, Phoenix, Ariz.

[73] Assignee: Krobar International, Inc., Scottsdale, Ariz.

[21] Appl. No.: 733,429

[22] Filed: Jul. 22, 1991

[51] Int. Cl.[5] ..... A45F 3/14

[52] U.S. Cl. ..... 224/250; 224/202; 224/919; 294/148; 206/315.9

[58] Field of Search ..... 224/191, 202, 205, 242, 224/250, 254, 919, 158, 242; 294/148, 149, 150; 206/315.9, 315.91, 583; 273/320; 229/87.04; 383/127, 118, 902, 907; 128/94, 95.1, 96.1, 100.1, 101.1, 99.1

[56] References Cited

U.S. PATENT DOCUMENTS

| | | | |
|---|---|---|---|
| 1,572,383 | 2/1926 | Dennys | 294/148 |
| 3,865,292 | 2/1975 | Foley | 294/149 |
| 3,918,618 | 11/1975 | Castaneda | 294/157 |
| 3,933,287 | 1/1976 | Foley | 294/149 |
| 4,119,247 | 10/1978 | Newquist et al. | 224/191 |
| 4,294,239 | 10/1981 | Oram et al. | 128/96.1 |
| 4,413,762 | 11/1983 | Carini | 224/250 |
| 4,510,982 | 4/1985 | Sangnori | 206/315.91 X |
| 4,836,427 | 6/1989 | McManus | 224/919 X |
| 4,887,752 | 12/1989 | Neuta | 224/202 |
| 4,989,656 | 2/1991 | Desfler | 383/907 |
| 5,085,320 | 2/1992 | Scott | 206/315.9 |

*Primary Examiner*—Henry J. Recla
*Assistant Examiner*—Glenn T. Barrett
*Attorney, Agent, or Firm*—LaValle D. Ptak

[57] ABSTRACT

A device for facilitating the carrying of various types of balls, such as basketballs, soccer balls, volley balls, footballs, and the like, consists of an elongated oval-shaped carrier made of elastic resilient material, such as neoprene. The length of the carrier is less than the outer circumference of the ball to be carried; and a flexible adjustable strap is provided between the two ends of the carrier to permit it to be securely and tightly pulled into contact with the ball. This causes the carrier to stretch or expand to the contour of the shape of the ball to be carried, and to hold the ball with constant frictional tension. A shoulder carrying strap is attached to the opposite ends of the carrier; so that the ball readily and easily can be carried by means of the shoulder strap.

6 Claims, 1 Drawing Sheet

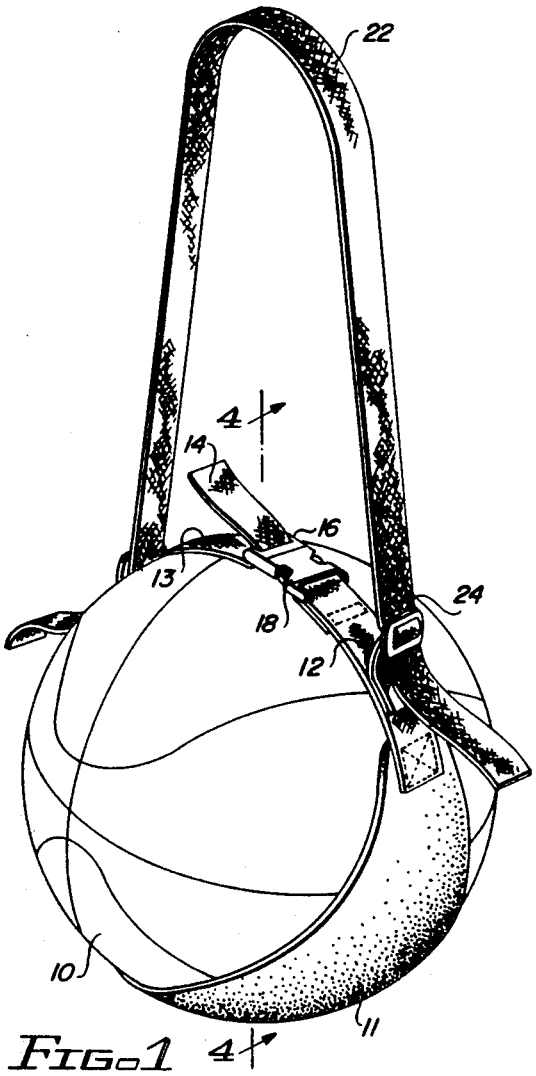
FIG. 1
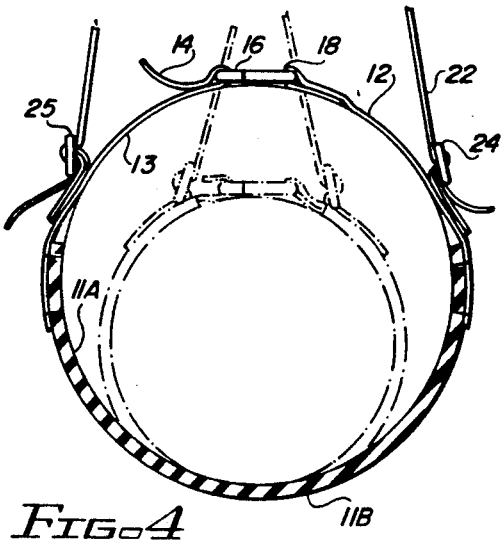
FIG. 4
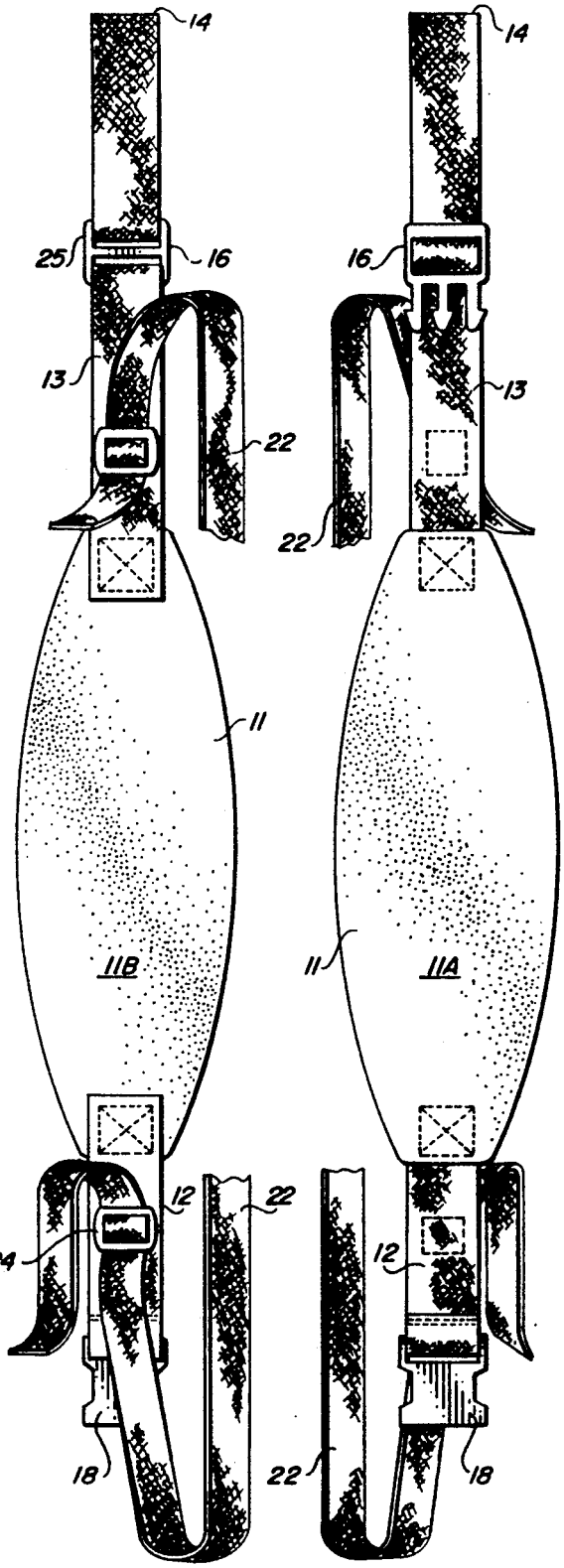
FIG. 2
FIG. 3

DEVICE FOR CARRYING BALLS

BACKGROUND

Frequently, professional and amateur athletes need to carry the balls used from one location to another. Many athletic balls, such as footballs, basketballs, volley balls, soccer balls, and the like, are relatively large, and are cumbersome to carry. Generally, the ball simply is tucked under one arm of the person transporting it. This means, however, that that arm is not free for any other purpose.

If an athlete, particularly an amateur juvenile athlete, desires to transport his or her ball from one location to another on a bicycle, it is dangerous to carry the ball under one arm and attempt to steer and otherwise operate the bicycle with the other arm. Carriers, in the form of bags or nets, have been designed for enabling a person to transport a ball such as a basketball, football, or the like, from one point to another. Such carriers, however, do not firmly engage the ball; so that a ball being carried in such a bag-like device can be spilled out of the device or knocked out of the device and fall to the ground.

Another approach is to provide a small duffle bag or satchel in which the ball and other items, such as shoes, towels, shorts, and the like may be carried. It still is necessary, with respect to such a duffle bag, to provide a handle or other means for a person to carry the duffle bag containing the ball and other items The inherent nature of duffle bags is that they are relatively bulky, and require a substantial amount of material, zippers, straps, and other fasteners to accomplish their purpose. Thus, even though some duffle bags are equipped with a shoulder strap to permit them to be carried over the shoulder of the user, the bulk and expense of this type of construction generally has made duffle bags or similar products unsuitable for transporting athletic balls from one location to another.

It is desirable to provide a carrier capable of carrying balls of a variety of sizes, which is simple in construction, and which firmly holds the ball to permit it to be easily transported from one location to another.

SUMMARY OF THE INVENTION

It is an object of this invention to provide an improved carrier for balls.

It is another object of this invention to provide an improved carrier for balls, which is capable of carrying athletic balls of different sizes.

It is an additional object of this invention to provide an improved athletic ball carrier which resiliently contours to the shape of the ball being carried, and which is lightweight and simple in construction.

It is a further object of this invention to provide a generally universal athletic ball carrier made, at least in part, of resilient stretch material, which conforms to the shape of the ball being carried, to firmly and securely hold the ball in place in the carrier.

In accordance with a preferred embodiment of this invention, a device for facilitating the carrying of athletic balls, such a basketballs, soccer balls, footballs, volley balls, and the like, comprises a primary carrier member made of resilient material. The carrier member has two ends, and is dimensioned to partially encircle the outer circumference of the ball to be carried, and to conform to the outer shape of the ball. A flexible strap is secured to at least one end of the carrier member, and this strap is releasably attached to the other end of the carrier member to cause the carrier member and strap to encircle the ball, and to be firmly attached to the ball for carrying.

BRIEF DESCRIPTION OF THE DRAWING

FIG. 1 is a perspective view of a preferred embodiment of the invention, illustrated in a typical use of the invention;

FIG. 2 is a bottom view of the embodiment shown in FIG. 1;

FIG. 3 is a top view of the embodiment shown in FIG. 1; and

FIG. 4 is a cross-sectional view taken along the line 4—4 of FIG. 1.

DETAILED DESCRIPTION

Reference now should be made to the drawing in which the same reference numbers are used throughout the different figures to designate the same components. FIG. 1 shows a typical athletic ball, such as a basketball or soccer ball 10, which is inserted into and carried by a preferred embodiment of the ball carrier of this invention.

The ball carrier comprises a primary carrier member 11 having a generally elongated oval shape (shown most clearly in FIGS. 2 and 3) for partially encircling and cradling the ball 10 when the device is in use. The carrier 11 is made of resilient stretch material, such as R1400 neoprene or the like. Typically, this material is between ¼" and 3/16" thick, and is substantially the same as the material in widespread use for wetsuits. The main carrier member 11 has an exposed, relatively high-friction rubber or neoprene surface 11A facing the side which engages the ball 10. bonded nylon or other suitable fabric capable of accommodating the elastic or stretch characteristics of the neoprene. Although the utilization of fabric such as nylon for the surface 11B is generally desired, it is not necessary for this surface to be any different from the surface 11A. A uniform neoprene oval 11 can be used, having a rubber-like surface on both sides 11A and 11B, if desired.

As is readily apparent in all figures, the opposite ends of the carrier member 11 are attached to a pair of straps 12 and 13. These straps are firmly secured, by sewing or other suitable means, to the opposite ends of the carrier member 11. The strap 12 is illustrated as terminating in a standard plastic female fastener 18, whereas the strap 13 is shown as looped through a male fastener portion 16. A free end 14 of the strap 13, which is looped through the fastener 16, permits adjustment of the relative length of the distance between the male and female fasteners 16 and 18 to allow the device to accommodate balls 10 of different diameters.

To use the device, the ball 10 is first placed on top of the surface 11A shown in FIG. 3. The straps 12 and 13 then are pulled upward to encircle the ball as shown in FIG. 1, and the fastener portions 16 and 18 are interengaged to close the loop or encircle the ball 10, as shown in FIG. 1. The strap 14 then is pulled tightly to stretch the material 11 around the ball 10, and to tightly engage the ball holder on the ball in the position shown in FIG. 1.

In FIG. 4, the cross-sectional configuration of the parts shown in FIG. 1 is illustrated in solid lines. If a smaller ball is placed in the carrier, the strap 14 is pulled to shorten the length of the strap 13 between the end secured to the carrier 11 and the fastener 16 to stretch the carrier 11 around the smaller ball, as shown in dotted lines in FIG. 4.

To complete the device, a shoulder strap 22 is secured to the ends of the carrier member 11 at substantially the same point that the straps 12 and 13 are secured. At least one end of the strap 22 is attached through an adjustable buckle 24. In the embodiment shown in FIGS. 1 through 4, both ends of the strap 22 are illustrated as being attached through adjustable buckles 24 and 25; although if desired, only a single adjustment buckle may be used.

If the device is not to be used for balls of a variety of different external dimensions, the adjustment feature provided by the strap 14 can be eliminated The device then would be sized to provide a proper stretch fit over a ball of a specific size when the connecter ends 16 and 18 are brought into engagement with one another. In most cases, however, the universal or multiple size capability which is illustrated in FIGS. 1 through 4 is desirable. It is readily apparent that balls of a variety of different shapes and sizes may be accommodated by the device.

It should be noted that the neoprene carrier member 11 produces an expansion grip on the ball by way of the stretching of the neoprene material. The carrier 11 then is held in constant frictional tension provided through contact with the ball by the straps 12 and 13 when they are secured together by the fasteners 16, 18, and after the strap 14 is pulled to tighten the grip of the carrier on the ball and to stretch the neoprene material 11.

It also is readily apparent that the device described and shown contours itself to the shape of any ball. The neoprene material 11 is self-contouring. Other self-contouring material, such as rubber or other types of elastic material, may be employed. The material used in the main carrier 11 must be capable of stretching at least in the longitudinal dimension between the straps 12 and 13. It also is possible to use four way stretch material, which can stretch in all directions, to enhance the self-contouring feature of the device.

Although specific materials have been described, and specific fasteners have been illustrated for the buckle parts 16 and 18, for example, various changes and modifications will occur to those skilled in the art without departing from the true scope of the invention. For example, other fasteners or buckles other than the one shown for the fasteners 16 and 18 can be employed. As already mentioned, materials other than neoprene may be used for the main carrier 11. Such materials must have the capability of stretching and conforming to the shape of the ball being carried. Other changes also will occur to those skilled in the art, without departing from the true scope of the invention as defined in the appended claims.

I claim:

1. A device for facilitating the carrying of balls having various outer shapes and various outer circumferences, such as basketballs, soccer balls, volley balls, footballs, and the like, said device including in combination:

a carrier member made of resilient stretch neoprene material having first and second ends, with dimensions selected to partially encircle an outer circumference of a ball to be carried, and made to stretch to conform to the outer shape of such ball, with said neoprene material having a rubber-like friction surface on at least one side, designed to contact a ball to be carried;

a manually adjustable flexible strap member with a first portion having a first end secured to the first end of said carrier member, and a second portion having a first end secured to the second end of said carrier member; and means for releasably, tightly attaching said flexible strap member to the second end of said carrier member, comprising mating connecting means on second ends of said first and second portions, respectively, for tightly pulling said carrier member into engagement with a ball when said connecting means are releasably attached to one another.

2. The combination according to claim 1 wherein said carrier member is formed in a substantially elongated oval shape for overlying a substantial portion of the outer surface of a ball to be carried by said device.

3. The combination according to claim 2 wherein said flexible strap member is made of substantially non-elastic material.

4. The combination according to claim 1 further including a shoulder carrying strap releasably attached to the first and second ends of said carrier member.

5. The combination according to claim 4 wherein said shoulder carrying strap has means for adjusting the length thereof.

6. The combination according to claim 1 wherein said shoulder carrying strap has means for adjusting the length thereof.

* * * * *